United States Patent [19]

Euzarraga

[11] 3,979,846

[45] Sept. 14, 1976

[54] POSTER SUPPORTING DEVICE

[75] Inventor: Rosendo Euzarraga, Anaheim, Calif.

[73] Assignee: Alpha Nova Development Corporation, Santa Ana, Calif.

[22] Filed: Mar. 27, 1975

[21] Appl. No.: 562,542

[52] U.S. Cl. ..... 40/125 G; 38/102.5

[51] Int. Cl.[2] ..... G09F 1/10

[58] Field of Search ..... 40/125 G, 125 F, 125 H, 40/125 N, 125 R; 38/102.3, 102.4, 102.5, 102.6, 102.8, 102.9, 102.91; 160/378, 394, 395; 211/45–48

[56] References Cited

UNITED STATES PATENTS

| | | | |
|---|---|---|---|
| 1,870,798 | 8/1932 | Einson | 40/125 G |
| 2,068,358 | 1/1937 | Stuebing | 40/125 G |
| 2,118,135 | 5/1938 | Baldwin | 40/125 G |
| 3,421,276 | 1/1969 | La Barge | 160/395 X |
| 3,485,165 | 12/1969 | Hughes | 160/378 X |

FOREIGN PATENTS OR APPLICATIONS

| | | | |
|---|---|---|---|
| 1,077,840 | 5/1954 | France | 40/125 G |

*Primary Examiner*—John F. Pitrelli
*Attorney, Agent, or Firm*—W. C. Babcock

[57] ABSTRACT

A device for use in maintaining that portion of a poster between upper and lower edge portions thereof in a flat configuration. First and second rigid frame piece assemblies removably engage upper and lower horizontal edge portions of the poster and are disposed to the rear thereof. First end portions of first and second elongate members engage the first and second frame assemblies with the elongate members situated to the rear of the poster, and with the elongate members being of sufficient length that the second end portions thereof overlap. The overlapping second end portions are frictionally and adjustably engaged by holding means to permit the device to be moved from a first to a second position, and when the poster device is in the second position, that portion thereof between the first and second end portions is slightly tensioned and disposed in a flat configuration whereby the poster and the device may be suspended from a wall by a conventional picture hanger.

9 Claims, 6 Drawing Figures

FIG. 1
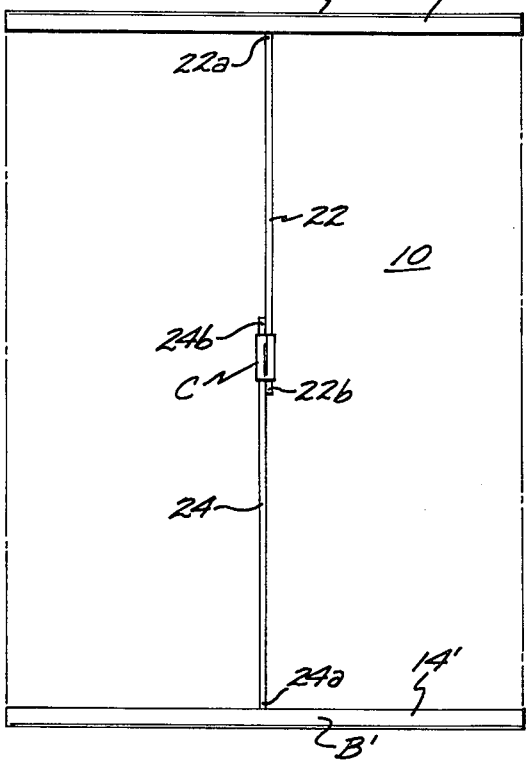
FIG. 3
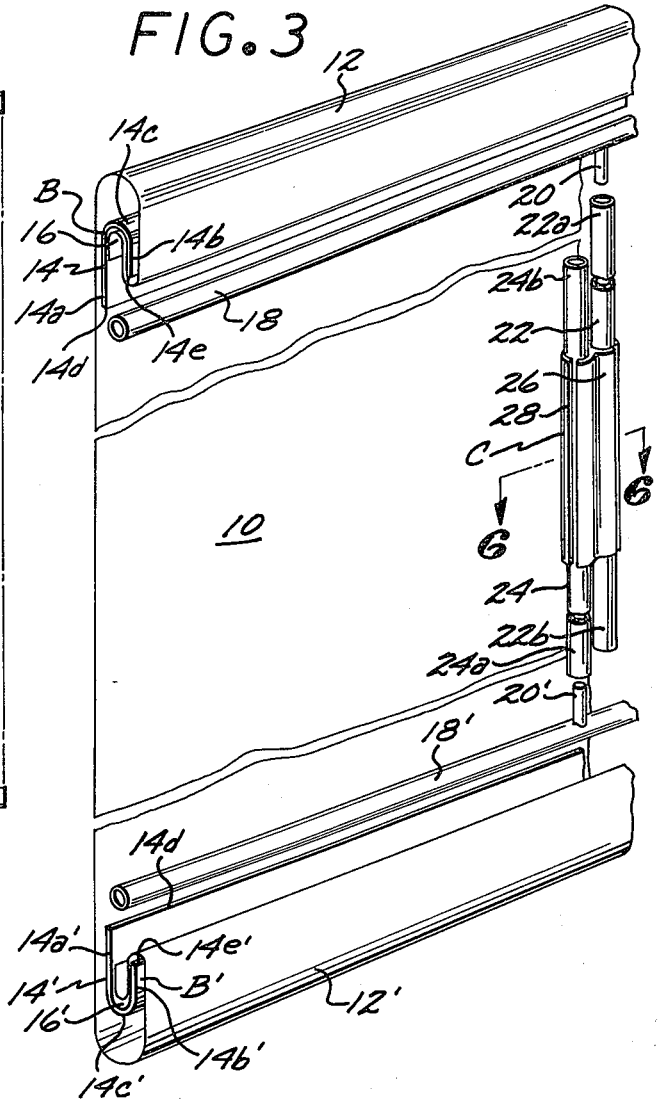
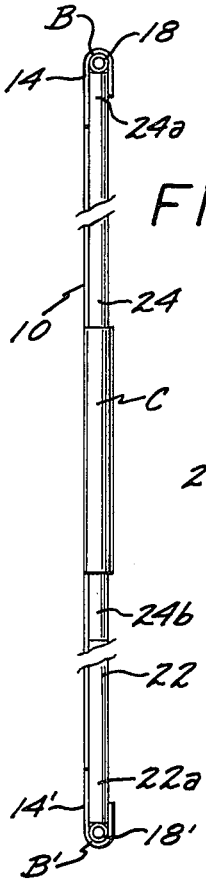
FIG. 2
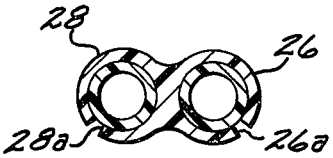
FIG. 6
FIG. 4
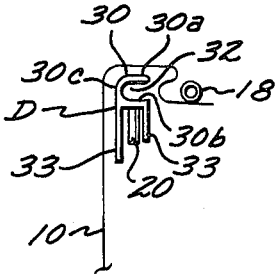
FIG. 5
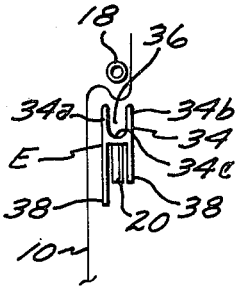

POSTER SUPPORTING DEVICE

BACKGROUND OF THE INVENTION

1. Field of the Invention

Poster Supporting Device

2. Description of the Prior Art

In the past few years, the popularity of posters for wall decorations has increased. However, prior to the present invention there has been no support for holding the poster in a flat configuration on a wall, other than a heavy, cumbersome frame or the taping of the poster to a wall, neither of which is particularly practical.

A major object of the present invention is to provide a poster supporting device that may be dismantled to occupy a minimum of space when not in use, one that is light in weight, can be fabricated from inexpensive, commercially available materials, is simple and easy to use, and can be retailed at a sufficiently low price as to encourage the widespread use thereof.

SMMARY OF THE INVENTION

A poster supporting device that may be retailed in a dismantled condition in a package that will occupy a minimum of space. The device includes first and second frame piece assemblies which may be removably secured to upper and lower edge portions of the poster without the use of hand tools. First and second elongate members are provided, the first end portions of which are removably securable to the frame assemblies. The first and second members are of sufficient length that second end portions thereof overlap. A connector is provided that adjustably engages the second end portions of the elongate members and permits the device to be moved from a first position where the poster is loosely supported between the frame piece assemblies to a second position where the poster is taut. That portion of the poster between the frame piece assemblies when the device is in the second position lies in a flat plane. When the device is in the second position, it is not visible for it is situated rearwardly of the poster.

BRIEF DESCRIPTION OF THE DRAWING

FIG. 1 is a rear elevational view of a poster having the upper and lower horizontal edge portions thereof removably engaged by the supporting device, with that part of the poster between the edge portions being held in a flat plane;

FIG. 2 is an end elevational view of the poster and the supporting device disposed on the rear side thereof;

FIG. 3 is an exploded perspective view of identical upper and lower frame piece assemblies prior to engaging upper and lower edge portions of the poster, first and second vertically extending elongate members that have first end portions which engage the upper and lower frame piece assemblies, a connector that adjustably engages second end portions of the elongate members to permit the supporting device to be moved from a first to a second position, with the device when in the second position holding that part of the poster between the frame assemblies in a flat plane;

FIG. 4 is a transverse cross-sectional view of a first alternate form of frame piece assembly;

FIG. 5 is a transverse cross-sectional view of a second alternate form of frame piece assembly; and FIG. 6 is a transverse cross-sectional view of the connector, taken on the line 6—6 of FIG. 3.

DESCRIPTION OF PREFERRED EMBODIMENTS

A rectangular poster 10 is shown in FIG. 1 that is formed of a sheet material sufficiently pliable that upper and lower edge portions 12 and 12' thereof as shown in FIG. 3 can be bent into the configuration shown therein.

The poster supporting device A, as may best be seen in FIG. 3 includes identical first and second frame piece assemblies B and B'. Frame piece assembly B includes an elongate frame piece 14 that is substantially the length as the width of the poster 10. Frame piece 14 is of channel shaped transverse cross section and is defined by first and second laterally spaced parallel flanges 14*a* and 14*b* that have first longitudinal edges thereof joined by an arcuate web 14*c*. First and second flanges 14*a* and 14*b* have second longitudinal edges 14*d* and 14*e*, respectively. The first and second flanges 14*a* and 14*b* and web 14*c* cooperatively define an elongate space 16, as shown in FIG. 3.

Frame piece assembly B includes an elongate anchor piece 18 that has a diameter slightly greater than that of the width of the space 16. When the upper edge portion 12 of poster 10 is bent, as shown in FIG. 3, to extend over the outer surfaces of first and second flanges 14*a*, 14*b* and web 14*c*, and inwardly adjacent the inner surface of second flange 14*b*, the anchor piece 18 may be inserted in space 16. The anchor piece 18 frictionally pressure contacts the inner surface of first flange 14*a* and that part of edge portion 12 in space 16 to removably lock frame piece assembly B to upper edge portion 12 of poster 10. Anchor piece 18 has a pin 20 extending downwardly from substantially the center thereof. A pin 20' extends upwardly from anchor piece 18'.

The second frame assembly B' is of the same structure as first frame assembly B. Elements of second frame assembly B' which are common to first assembly B are identified by the same numerals used in FIG. 3, but to which primes have been added.

First and second tubular members 22 and 24 are provided that have first ends 22*a* and 24*a*. Tubular members 22 and 24 are disposed in side-by-side relationship, and are of sufficient length as to have second end portions 22*b* and 24*b* that overlap one another. Pin 20 is removably engaged by first end 22*a* of first member 22. Pin 20' is likewise removably engaged by first end 24*a* of second elongate member 24 as shown in FIG. 3.

A connector C shown in FIG. 3 is defined by first and second tubes 26 and 28 that have first longitudinal segments joined to one another. First and second longitudinal slits 26*a* and 28*a* are formed in first and second tubes 26 and 28 as shown in FIG. 6. The diameters of the bores in first and second tubes 26 and 28 are less than the external diameters of second end portions 22*b* and 24*b*. As a result, the connector C adjustably and frictionally engages second end portions 22*b* and 24*b* to the extent that the poster support device A may be moved from a first position where poster 10 is loosely supported between first and second frame piece assemblies B and B' to a second position where the poster 10 is taut and lies in a flat plane.

A first alternate frame piece assembly D is shown in FIG. 4 that includes an elongate frame piece 30 that has first and second flanges 30*a* and 30*b* which are connected on first longitudinal edges by a web 30*c*. First and second flanges 30*a*, 30*b* and web 30*c* cooperatively define a horizontal space 32 of a width less than the diameter of anchor piece 18. The material defining frame piece assembly D, as well as frame piece assemblies B and B′, is preferably a resilient polymerized resin, athough a lightweight resilient metal or alloy may be employed if desired. When first edge portion 12 is bent as shown in FIG. 4, it is removably held in frame piece assembly D when anchor piece 18 is inserted in space 32. To add rigidity to frame piece assembly D, the second flange 30*b* may have a pair of ribs 33 extending outwardly therefrom. Second flange 30*b* has a pin 20 extending downwardly therefrom that engages first end 22*a* of first member 22. A like frame assembly D is provided for the lower edge portion 12′ of poster 10.

A second alternate frame piece assembly E is shown in FIG. 5 that includes an elongate frame piece 34 that is defined by first and second flanges 34*a*, 34*b* and a connecting web 34*c*. The flanges 34*a*, 34*b* and web 34*c* cooperatively define a space 36 that is narrower than the diameter of anchor piece 18. A pin 20 extends from web 34*c* that engages end portion 22*a* of first member 22. When edge portion 12 of poster 10 is bent as shown in FIG. 5, it may be removably secured to second alternate end piece assembly E by inserting anchor piece 18 into space 36. Second alternate end piece D may be strengthened longitudinally by a pair of ribs 38 which extend from web 34*c*. An identical frame piece assembly E is provided for edge portion 12′ of poster 10.

The use and operation of the poster support assemblies has been explained previously and need not be repeated.

I claim:

1. A device for use in maintaining a rectangular poster formed from a pliable sheet material and having upper and lower positionable edge portions in a configuration wherein those portions of said poster between said edge portions are held in a flat plane, said device sufficiently thin as to be hung on a wall in abutting contact therewith which device includes:

a. first elongate rigid means that removably engage said upper edge portion said first means includes:

an elongate frame piece of channel shaped transverse cross sections, said frame piece being of substantially the same length as the width of said poster, said frame piece being defined by first and second, laterally spaced flanges that have first and second longitudinal edges and said first edges being connected by an elongate web, with said first and second flanges and web defining an elongate space therebetween that is parallel to said portion of said poster between said edge portions when said device is in said second position; and an elongate anchor piece that has a transverse cross section slightly greater than the width of said space, with said upper portion when extending over outer surfaces of said first flange, web and second flange and interior surface of said second flange being held in said frame piece when said anchor piece is inserted in said space to pressure and frictionally engage an interior surface of said first flange and that part of said end portion adjacent an interior surface of said second flange;

b. second elongate rigid means that removably engage said lower edge portion;

c. first and second elongate rigid members, each of which have first and second end portions;

d. third means for securing said first end portions to substantially the centers of said fist and second means and in a direction normal thereto, with said first and second members being of sufficient length that said second end portions overlap; and e. fourth means for adjustably engaging said second end portions to permit said first and second means and said first and second members to be moved oppositely from a first to a second position where said portion of said portion between said edge portions is taut and disposed in said flat plane, said fourth means comprise first and second elongate resilient tubes having first and second bores therein of smaller transverse cross section than that of said second end portions of said first and second members, with said first and second tubes including first longitudinal sections that are joined to one another and second longitudinal sections in which slits are defined that extend the length thereof, which first and second tubes when the first and second bores therein are engaged by said second end portions of said elongate members frictionally grip the same to hold said device in said second position.

2. A device as defined in claim 1 wherein said second means is of the same structure as said first means.

3. A device as defined in claim 2 wherein said third means comprise first and second opposed pins supported in fixed positions at substantially the centers of said anchor pieces and engaged by bores in said first end portions of said first and second elongate members.

4. A device for use in maintaining a rectangular poster formed from a pliable sheet material and having upper and lower positionable edge portions in a configuration wherein those portions of said poster between said edge portions are held in a flat plane, said device sufficiently thin as to be hung on a wall in abutting contact therewith which device includes:

a. first elongate rigid means that removably engage said upper edge portion said first means includes:

an elongate frame piece of channel shaped transverse cross section, said frame piece being of substantially the same length as the width of said poster, which frame piece is defined by first and second laterally spaced flanges that have first and second longitudinal edges, and an elongate web that connects said first edges with said first and second flanges and web defining an elongate space therebetween that is in a direction normal to said portion of said poster between said edge portions when said device is in said second position; and an elongate anchor piece that has a transverse cross section slightly greater than the width of said space, with said upper portion when extending over the outer surface of said first flange, the interior surfaces of said first flange, web and second flange being held in said frame piece when said anchor piece is inserted in said space to pressure and frictionally contact that part of said upper edge portion of said poster in said elongate space, b. second elongate rigid means that removably engage said lower edge portion;

c. first and second elongate rigid members, each of which have first and second end portions;

d. third means for securing said first end portions to substantially the centers of said first and second means in a direction normal thereto, with said first and second members being of sufficient length that said second end portions overlap; and e. fourth means for adjustably engaging said second end portions to permit said first and second means and said first and second members to be moved oppositely from a first to a second position where said portion of said portion between said edge portions is taut and disposed in said flat plane; said fourth means comprise first and second elongate resilient tubes having first and second bores therein of smaller transverse cross section than that of said second end portions of said first and second members, with said first and second tubes including first longitudinal sections that are joined to one another and second longitudinal sections in which slits are defined that extend the length thereof, which first and second tubes when the first and second bores therein are engaged by said second end portions of said elongate members frictionally grip the same to hold said device in said second position.

5. A device as defined in claim 4 wherein said second means is of the same structure as said first means.

6. A device as defined in claim 5 wherein said third means comprise first and second opposed pins secured in fixed positions at substantially the centers of said second flanges of said frame pieces of said first and second means which engage bores in said first end portions of said first and second elongate members.

7. A device for use in maintaining a rectangular a rectangular poster formed from a pliable sheet material and having upper and lower positionable edge portions in a configuration wherein those portions of said poster between said edge portions are held in a flat plane, said device sufficiently thin as to be hung on a wall in abutting contact therewith which device includes:

a. a first elongate rigid means that removably engage said upper edge portion said first means includes: an elongate frame piece of channel shaped transverse cross section, which frame piece is substantially the same length as the width of said poster, with said frame piece being defined by first and second laterally spaced flanges that have first and second longitudinal edges, and a web that connects said first edges, said first and second flanges and web defining an elongate space therebetween that is parallel to said portion of said poster between said edge portions when said device is in said second position, with said elongate space extending away from said portion; and an elongate anchor piece that has a transverse cross section slightly greater than the width of said space, with said upper portion when extending over the outer surface of said first flange, web and second flange being held in said frame piece when said anchor piece is inserted in said space to pressure and frictionally engage that port of said upper portion disposed in said space;

b. second elongate rigid means that removably engage said lower edge portion;

c. first and second elongate rigid members, each of which have first and second end portions;

d. third means for securing said first end portions to substantially the centers of said first and second means in a direction normal thereto, with said first and second members being of sufficient length that said second end portions overlap; and e. fourth means for adjustably engaging said second end portions to permit said first and second means and said first and second members to be moved oppositely from a first to a second position where said portion of said portion between said edge portions is taut and disposed in said flat plane; said fourth means comprise first and second elongate resilient tubes having first and second bores therein of smaller transverse cross section than that of said second end portions of said first and second members, with said first and second tubes including first longitudinal sections that are joined to one another and second longitudinal sections in which slits are defined extend the length thereof, which first and second tubes when the first and second bores therein are engaged by said second end portions of said elongate members frictionally grip the same to hold said device in said second position.

8. A device as defined in claim 7 wherein said second means is of the same structure as said first means.

9. A device as defined in claim 8 wherein said third means are opposed first and second pins in fixed positions at substantially the center of said webs of said first and second frame pieces of said first and second means and engaging bores in said first end portions of said first and second elongate members.

* * * * *